US006203401B1

(12) United States Patent
Weber

(10) Patent No.: US 6,203,401 B1
(45) Date of Patent: Mar. 20, 2001

(54) DEVICE FOR SUPERFINISHING TREATED SURFACES

(75) Inventor: Wilfried Weber, Freudenstadt (DE)

(73) Assignee: Supfina Grieshaber GmbH & Co., Remscheid (DE)

( * ) Notice: Subject to any disclaimer, the term of this patent is extended or adjusted under 35 U.S.C. 154(b) by 0 days.

(21) Appl. No.: 09/139,128

(22) Filed: Aug. 31, 1998

(30) Foreign Application Priority Data

Feb. 9, 1998 (DE) ..... 198 04 885

(51) Int. Cl.[7] ..... B24B 49/00

(52) U.S. Cl. ..... 451/5; 451/11; 451/24; 451/51; 451/221; 451/385

(58) Field of Search ..... 451/5, 11, 24, 451/27, 51, 52, 221, 226, 227, 246, 385, 387, 398

(56) References Cited

U.S. PATENT DOCUMENTS 5,031,303 * 7/1991 Orain .
5,097,635 * 3/1992 Beasley .
5,681,209 * 10/1997 Naumann et al. .
5,816,899 * 10/1998 Hart et al. .
5,934,975 * 4/1999 Svanberg .

FOREIGN PATENT DOCUMENTS

4423422A1 1/1996 (DE) .

* cited by examiner

*Primary Examiner*—Timothy V. Eley
*Assistant Examiner*—Willie Berry, Jr.
(74) *Attorney, Agent, or Firm*—Jones, Tullar & Cooper, P.C.

(57) ABSTRACT

A device for superfinishing of ground surfaces of workpieces has a finishing block, which can be displaced by means of a drive device in a plane which is orthogonal with respect to the surface to be worked and is pivotable in this plane. By means of this it is possible to create a device of relatively small structural size, by means of which any arbitrary surfaces of workpieces can be treated.

13 Claims, 3 Drawing Sheets

DEVICE FOR SUPERFINISHING TREATED SURFACES

TECHNICAL FIELD

The present invention relates to a device for superfinishing treated, in particular finished or ground, surfaces of work pieces, having a clamping device for the workpiece, a finishing block as the tool, a holder for the finishing block, a multi-axis drive device for performing a multi-axis relative movement between the surface to be treated and the holder in a plane which is orthogonal with respect to the surface to be treated and is defined by the coordinates X and Y, as well as a control unit for controlling the drive device, wherein the control unit has input means for inputting the profile of the surface to be treated, as well as electronic calculating means.

BACKGROUND OF THE INVENTION

It is known that ground surfaces of workpieces, in particular of roller bearings, are finished in a further work step wherein, for one, the roughness of the surface is reduced, and furthermore accuracy as to shape and dimension is increased. As a rule, up to 6 $\mu$m of material are removed during this finishing process, in special cases even 50 $\mu$m and more. Flat surfaces are worked by means of a flat finishing block, which is used in the plane of the surface. Curved surfaces are also worked with a finishing block, wherein the work surfaces of the finishing block in this case are not flat, but matched to the curvature of the surface to be worked. The block is pivoted during the treatment, so that at all times it rests flat against the workpiece to be treated, or respectively on its surface to be treated. To this end the finishing block is clamped in a pivoting device, whose pivot axis is located in the center of curvature of the surface to be treated. It has been shown that only a limited number of workpieces can be treated by means of such devices. Workpieces with a slight curved surface, i.e. with surfaces whose radius of curvature is very large, cannot be treated with such devices, since as a rule the pivot arm for pivoting the finishing block is too short. This applies in particular to angularly adjustable movable bearings and large spherical roller bearings.

CNC treatment machines are furthermore known, by means of which treatment tools, for example drills, turning chisels, and the like can be displaced in space. However, such tools have point-shaped or line-shaped cutting surfaces, so that, although the angular position of the tool with respect to the workpiece is determined by the effective tool side rake, this effective tool side rake can be variable over relatively large ranges. Machines of this type are not suitable for tools which treat the workpiece not at points or along lines, but in a planar manner, namely by means of a finishing block. In relation to the tool, this finishing block must not only be exactly positioned in the X, Y plane, but also in its angular position, so that the cutting surface of the finishing block at all times rests flat on the surface of the workpiece to be treated.

SUMMARY OF THE INVENTION

It is therefore an object of the present invention to make a device available, by means of which such workpieces can also be relatively easily treated.

This object is attained by means of a finishing device of the species mentioned at the outset in that by means of a pivoting device the holder is seated pivotable around a virtual pivot axis which is orthogonal with respect to the X, Y plane, and that the pivot angle of the holder corresponding to the position of the finishing block can be determined by means of calculating means, and that the pivoting device can be controlled from the control unit.

By means of the device in accordance with the present invention the finishing block is not only displaced in the X, Y plane by means of the drive device, but is also pivoted in such a way that the finishing block rests at all times flat on the surface of the workpiece to be treated. The pivot angle corresponding to each position of the finishing block is calculated by the calculating means from the geometry of the surface to be treated, or respectively from the profile of the workpiece. As a rule, two points and the radius of curvature of the surface are required for this. The virtual pivot angle around which the finishing block is exclusively pivoted is calculated from this data. Because this virtual pivot angle can be at a very large distance from the surface to be treated, the finishing block is displaced in the X direction as well as the Y direction by means of the drive device, and is additionally pivoted around an actual pivot axis. This movement over the plane as well as pivoting around the actual pivot axis corresponds to pivoting around the virtual pivot axis. However, the actual pivot axis is located inside the finishing device, and in particular inside the pivoting device and is constituted by a pivot bearing. By means of the device in accordance with the present invention it is now possible to treat workpieces which have very large radii of curvature, or respectively have a flat surface to be treated (whose radius of curvature is infinite).

In accordance with a preferred exemplary embodiment, the pivoting device is integrated into the drive device. Thus, the finishing block is displaced in the X and Y direction by means of the drive device, which is accomplished in that the pivoting device on which the holder of the finishing block is provided is displaced by means of the drive device. In addition, the holder, and therefore also the finishing block, are pivoted by means of the pivoting device.

However, there is also the option that the pivoting device is fixed in place on the machine, and a drive device is provided in the pivoting device, which displaces the holder for the finishing block in two directions which are orthogonal with respect to each other.

In accordance with the present invention this pivoting device can be activated electrically, for example by means of servo motors or the like, electro-magnetically, hydraulically and/or pneumatically. In particular, this pivoting device has an oscillator, by means of which the holder can be oscillatingly moved.

The device in accordance with the present invention is suitable for working flat and curved surfaces, as well as concave and convex surfaces. In addition it is possible to work surfaces which are inclined, so that the virtual pivot axis is located outside of the plane of the component, which as a rule has a ring shape.

A further development provides that the holder and/or the drive device has a contact pressure device for the finishing block. This contact pressure device at all times keeps the finishing block on the surface to be treated and drives it with a predetermined force. The desired amount is removed and the wear of the finishing block is compensated in this manner. The contact pressure device can preferably be actuated pneumatically or hydraulically, but the finishing block can also be pressed against the surface to be worked by means of a spring force. A pneumatic device has the considerable advantage that the contact pressure can be maintained constant in a relatively simple manner.

One variant of the device in accordance with the present invention is embodied in such a way that the actual pivot axis is located in the tangent plane of the finishing block and the surface to be treated. In connection with a preferred exemplary embodiment the actual pivot axis is located between the tangent plane and the location of the virtual pivot axis. The position of the actual pivot axis is preferably displaceable with respect to the surface to be worked.

Further advantages, characteristics and details of the present invention ensue from the claims and the following description, in which a particularly preferred exemplary embodiment is described with reference to the drawings. It is possible here that the characteristics illustrated in the drawings and mentioned in the specification and claims are respectively important to the present invention both individually as well as in any arbitrary combination.

DESCRIPTION OF THE PREFERRED EMBODIMENT

Figure 1:
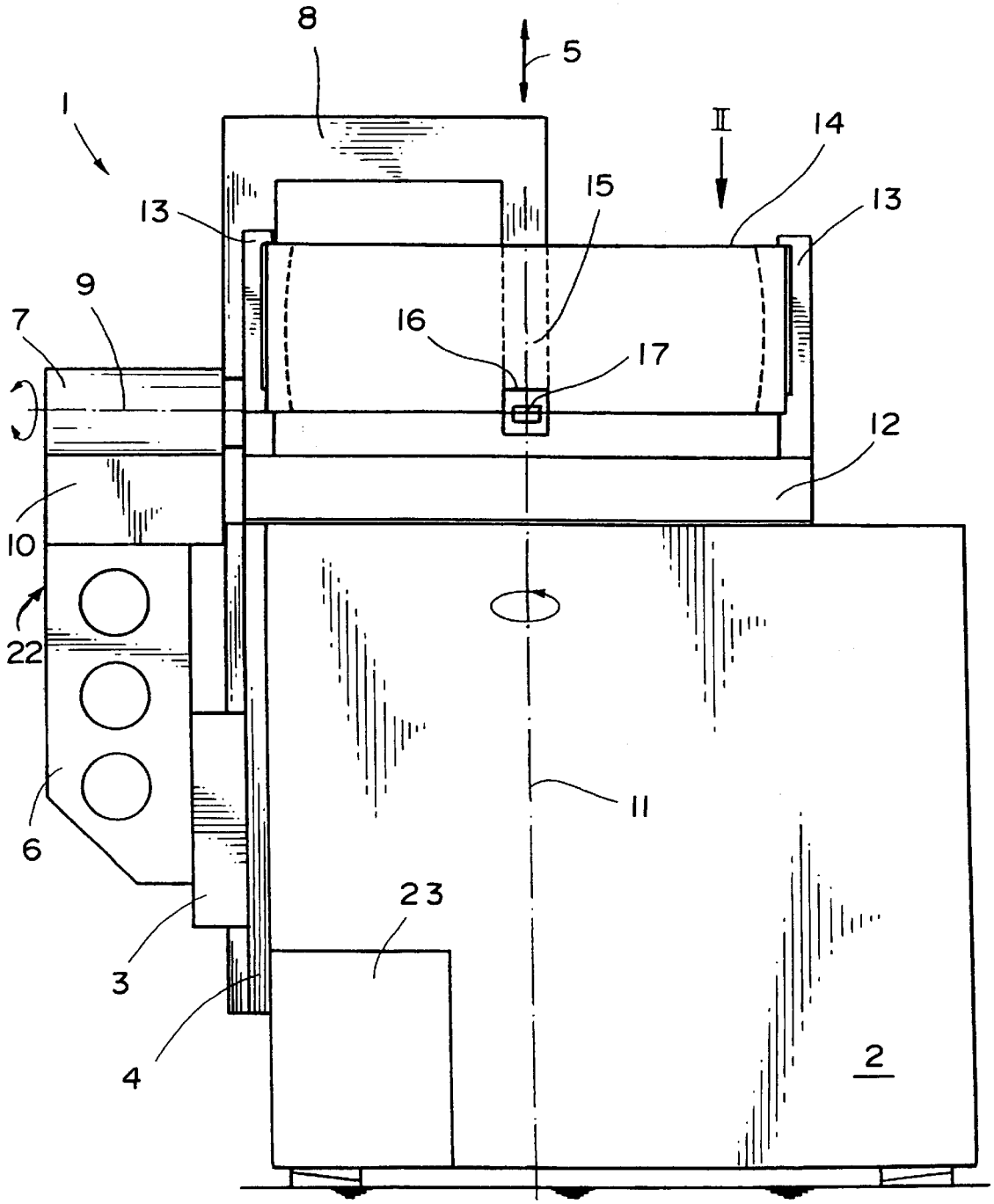
FIG. 1, is a lateral view of the finishing device in accordance with the present invention.

FIG. 1 represents a finishing device, identified as a whole by 1, with a machine housing 2, in which service units, drives, a control device 23 with calculating means and the like for the device 1 are housed. A carriage 3 is located on the machine housing, which can be displaced on a vertical guide track 4 in the Y direction (two-headed arrow 5). A pivoting device 7, on which a pivot arm 8 is seated pivotable around a pivot axis 9, is fastened by means of a support arm 6 on this carriage 3. This pivoting device 7 can be displaced in the vertical direction by means of the carriage 3. A further carriage 10 is located between the pivoting device 7 and the support arm 6, by means of which the pivoting device 7 can be displaced in a direction which is orthogonal with respect to the plane of projection, namely in the X direction.

Figure 2:
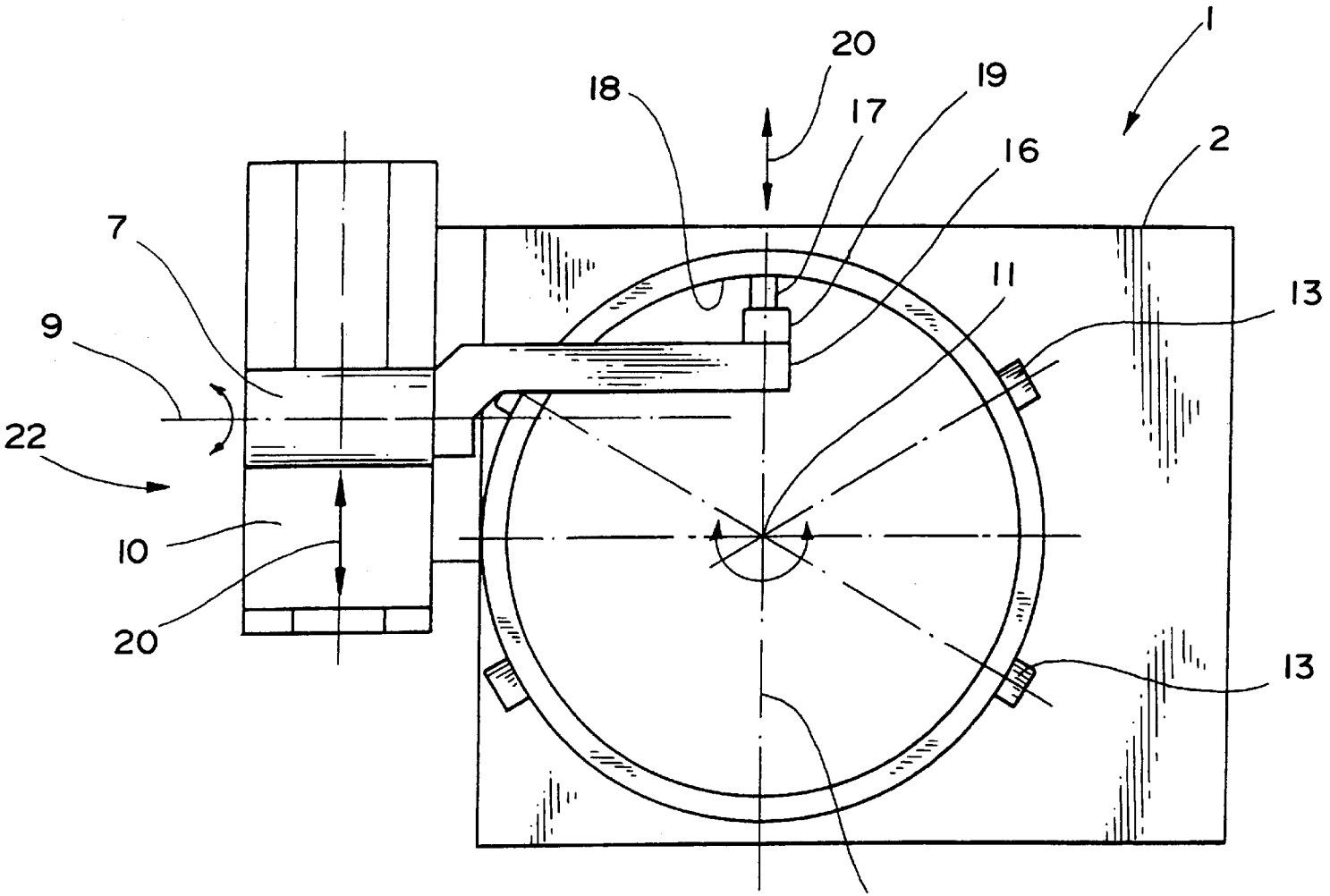
FIG. 2, is a top view in the direction of the arrow II in FIG. 1.

A rotary drive with an axis of rotation 11 is located inside the machine housing 2, by means of which a face plate 12 can be set to rotate. A workpiece 14 is fastened by means of holding devices 13 on this face plate 12 and can be rotated around the axis of rotation 11. The axis of rotation 11 and the central axis of the workpiece 14 are here located coaxially with respect to each other. The pivot arm 8 has the shape of a U, open toward the bottom, and engages the workpiece 14 with its free end 15. A holder 16 is located on this free end 15, which receives a finishing block 17. This finishing block 17 engages the interior surface 18 to be worked (FIG. 2). The finishing block 17 rests flat against the interior surface 18. On its contact surface the finishing block 17 therefore has the same curvature as the interior surface 18.

The two carriages 3 and 10 constitute a drive device 22 for the holder 16, or respectively the finishing block 17 in the X direction 20 as well as the Y direction 5.

In FIG. 2 the finishing device 1 is shown in a top view in the direction of the arrow II in FIG. 1. It can be clearly seen how the finishing block 17 rests against the interior surface 18. The holder 16 has a contact pressure device 19, by means of which the finishing block 17 is pressed against the interior surface 18 with a constant force. The pivoting device 7 is displaced in the direction of the two-headed arrow 20, i.e. in the X direction, by means of the carriage 10. Therefore the two carriages 3 and 10 permit travel over the interior surface 18 of the workpiece 14 in the X, Y plane 21. Furthermore, the finishing block 17 is pivoted around the pivot axis 9 by means of the pivoting device 7 in such a way that it rests flat against the interior surface 18 at all times. The pivot axis 9 here is at a distance from the interior surface 18. However, when using a differently shaped pivot arm 8 there is also the possibility that the pivot axis 9 comes to lie exactly in the contact surface between the interior surface 18 and the finishing block 17, i.e., in the tangent plane to the finishing block and the surface of the workpiece to be treated.

Figures 3A, 3B, 3C, 3D, 3E, 3F:
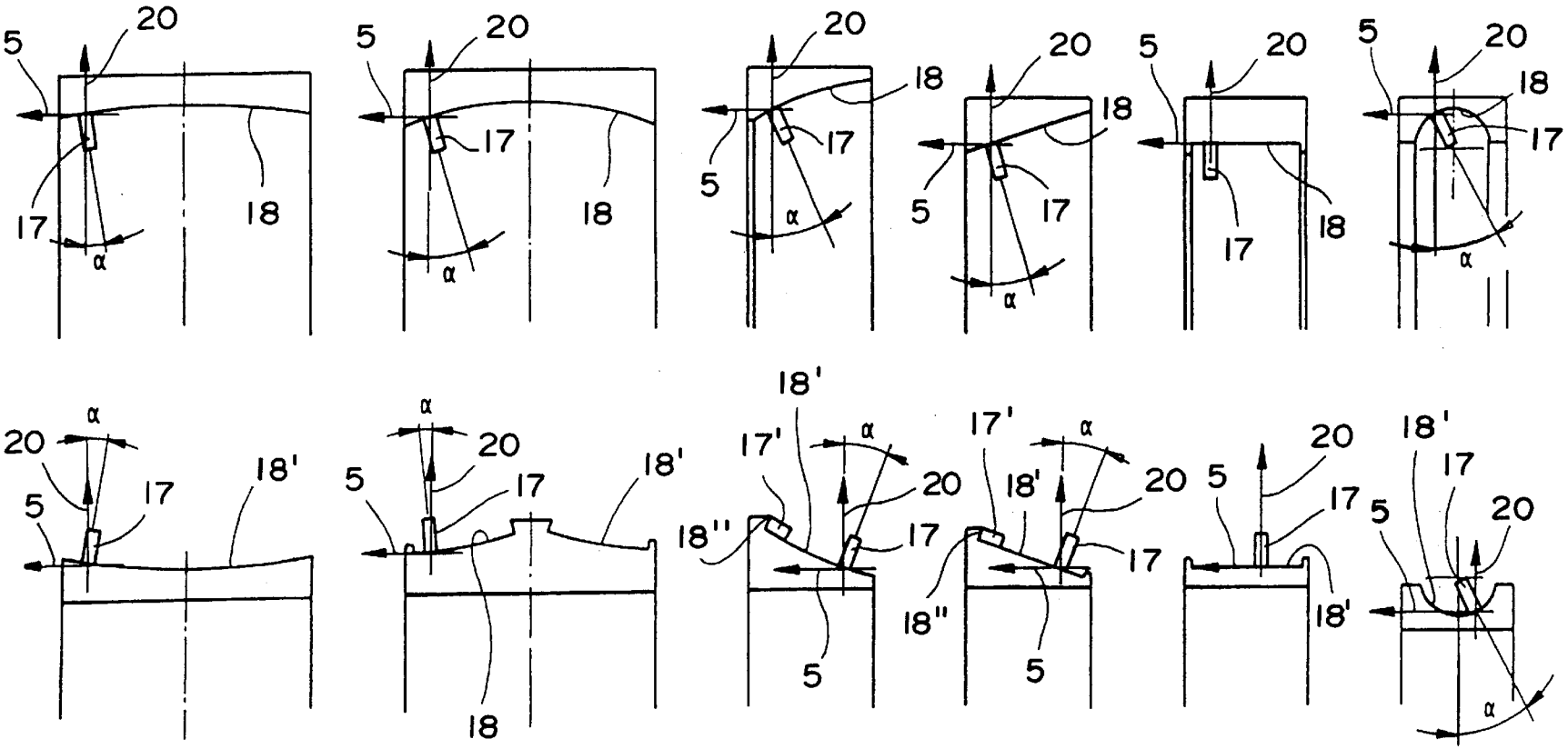
FIGS. 3*a*–3*f*, show several workpieces which can be worked by means of the device.

Any arbitrary workpieces with flat or cylindrical surfaces can be treated by means of the finishing device 1 in accordance with the present invention. However, usually the workpieces have surfaces which represent sections of a torus. Several outer rings (top) and inner rings (bottom) of different rolling bearings are represented in FIG. 3. FIG. 3*a* represents an angularly adjustable movable bearing, whose interior surface 18 is worked by the finishing block 17. This finishing block 17 is displaced in the X direction 20 (vertically) and in the Y direction 5 (horizontally), and is pivoted by the pivoting device 7 over the pivot angle $\alpha$. This also applies to the exterior surface 18' of the inner ring.

FIG. 3*b* shows a spherical roller bearing, wherein the outer ring has a smaller radius of curvature in comparison with FIG. 3*a*. In this case the inner ring has two interior surfaces 18' to be worked. FIG. 3*c* shows an axial spherical roller bearing with inclined, curved surfaces 18 and 18'. In addition the inner ring has a further surface 18" to be worked, which is treated by means of a finishing block 17'.

FIG. 3*d* shows a tapered roller bearing with cone-shaped surfaces 18 and 18', wherein the finishing block here is only inclined, but is not being pivoted. Here, too, the inner ring has a second surface 18" to be worked, which is treated by means of a finishing block 17'.

FIG. 3*e* shows a cylindrical roller bearing with cylindrical surfaces 18 and 18', wherein the finishing block 17 is here neither inclined nor pivoted.

FIG. 3*f* shows a deep groove ball bearing, wherein the surfaces 18 and 18' have very small radii of curvature, so that the finishing block 17 is nearly not displaced in the X direction 20 and the Y direction 5, but wherein the pivot angle $\alpha$ is relatively large.

Axial bearings and axial roller bearings can also be worked with the finishing device 1 in accordance with the present invention, wherein in connection with axial bearings the surface to be treated is flat.

As a whole it can be stated that, as represented in FIG. 3, flat surfaces as well as sectional surfaces of a torus can be worked.

What is claimed is:

1. A device for superfinishing treated surfaces of a workpiece, comprising:

a clamping device for supporting the workpiece;

a finishing block for finishing a surface of the workpiece;

a holder for supporting said finishing block;

a multi-axis drive device for driving said holder and effecting a multi-axis relative movement between the surface of the workpiece to be treated and said holder in a plane which is orthogonal to the surface of the workpiece to be treated;

a control unit for controlling said multi-axis drive device, said control unit including: input means for inputting the profile of the surface of the workpiece to be treated to the control unit; and electronic calculating means; and a pivoting device connected to said holder and said control unit, wherein:

said holder is seated pivotably about a virtual pivot axis by means of said pivoting device, said virtual pivot axis being orthogonal with respect to said plane;

the pivot angle of said holder correspond to the position of said finishing block is determined by means of said calculating means; and said pivoting device is controlled by said control unit.

2. The device as defined in claim 1, wherein said pivoting device is integrated into said multi-axis drive device.

3. The device as defined in claim 1, wherein said pivoting can be activated by one of: electrical, electro-magnetic, hydraulic and/or pneumatic activation.

4. The device as defined in claim 1, wherein the surface of the workpiece to be treated is a curved surface, which can be curved as one of: an arc of a circle, and in the form of a torus.

5. The device as defined in claim 1, wherein the workpieces have concave surfaces to be treated.

6. The device as defined in claim 1, wherein the workpieces have convex surfaces to be treated.

7. The device as defined in claim 1, further comprising:

a contact pressure device included as part of said holder to which said finishing block is connected.

8. The device as defined in claim 1, further comprising:

a contact pressure device included as part of said drive device to which said finishing block is connected.

9. The device as defined in claim 1, further comprising:

a contact pressure device included as part of said holder and said drive device to which said finishing block is connected.

10. The device as defined in claim 1, further comprising:

a contact pressure device including a spring, said contact pressure device being charged by one of pneumatic and hydraulic charging, and wherein said contact pressure device presses said finishing block against the surface to be treated by a spring force exerted by said spring.

11. The device as defined in claim 1, wherein said pivoting device is pivoted about a pivot axis, and wherein said pivot axis is located in a tangent plane to said finishing block and the surface of the workpiece to be treated.

12. The device as defined in claim 1, wherein said pivoting device is pivoted about a pivot axis, and wherein said pivot axis is located between the tangent plane to said finishing block and the surface of the workpiece to be treated and the location of said virtual pivot axis.

13. The device as defined in claim 1, wherein the surface of the workpiece to be treated is flat.

* * * * *